US007886638B2

(12) United States Patent
Knoll et al.

(10) Patent No.: US 7,886,638 B2
(45) Date of Patent: Feb. 15, 2011

(54) PLIERS

(75) Inventors: Christian Knoll, Munich (DE); Philipp Böhmel, Stuttgart (DE); Michael Winkler, Vörstetten (DE); Otmar Karle, Vörstetten (DE)

(73) Assignee: Wiha Werkzeuge GmbH, Schonach (DE)

( * ) Notice: Subject to any disclaimer, the term of this patent is extended or adjusted under 35 U.S.C. 154(b) by 189 days.

(21) Appl. No.: 12/086,904

(22) PCT Filed: Dec. 21, 2006

(86) PCT No.: PCT/EP2006/012376

§ 371 (c)(1),
(2), (4) Date: Jun. 19, 2008

(87) PCT Pub. No.: WO2007/076954

PCT Pub. Date: Jul. 12, 2007

(65) Prior Publication Data

US 2009/0277312 A1 Nov. 12, 2009

(30) Foreign Application Priority Data

Dec. 22, 2005 (DE) ..... 10 2005 063 221
Sep. 28, 2006 (DE) ..... 10 2006 046 099

(51) Int. Cl.
*B25B 7/12* (2006.01)
*B25B 7/06* (2006.01)

(52) U.S. Cl. ..... 81/383

(58) Field of Classification Search ..... 81/383, 81/362, 416

See application file for complete search history.

(56) References Cited

U.S. PATENT DOCUMENTS 1,541,248 A * 6/1925 Carlson ..... 81/382
1,709,378 A * 4/1929 Sulger ..... 81/384

(Continued)

FOREIGN PATENT DOCUMENTS

DE 22 35 134 A1 2/1974

(Continued)

*Primary Examiner*—David B Thomas
(74) *Attorney, Agent, or Firm*—Harness, Dickey & Pierce, P.L.C.

(57) ABSTRACT

A pliers includes first and second pliers parts and an articulation that pivotably connects the pliers parts. The articulation is arranged on at least one of the pliers parts between its ends. First and second handle elements associated with the first and second pliers parts. The first pliers part is connected rotation-fast to the first handle element. The second pliers part is pivotably connected to the second handle element. A coupling element that is pivotably attached to the second handle element has a hinge point arranged on the second handle element spaced apart from the hinge point of the second pliers part on the second handle element. The coupling element is also pivotably attached to the first pliers part or to the first handle element. The hinge point of the coupling element is arranged on the first pliers part or on the first handle element spaced apart from the articulation that connects the pliers parts. A first imaginary connecting line running between the articulation and the hinge point of the second pliers part on the second handle element is largely parallel to a second imaginary connecting line that connects the hinge point between coupling element and first handle element and the hinge point between coupling element and second handle element.

16 Claims, 4 Drawing Sheets

U.S. PATENT DOCUMENTS

| | | | | | |
|---|---|---|---|---|---|
| 1,710,929 | A | * | 4/1929 | Kelleway | 81/381 |
| 3,459,187 | A | | 8/1969 | Palota | |
| 4,381,661 | A | * | 5/1983 | Wiener et al. | 72/409.12 |
| 4,643,054 | A | * | 2/1987 | Nelson | 81/352 |
| 4,825,735 | A | * | 5/1989 | Undin | 81/352 |
| 4,890,356 | A | | 1/1990 | Czech et al. | |
| 5,267,464 | A | * | 12/1993 | Cleland | 72/409.12 |
| D349,636 | S | * | 8/1994 | White et al. | D8/52 |
| 5,435,214 | A | * | 7/1995 | Sisson | 81/376 |
| 6,065,376 | A | * | 5/2000 | Khachatoorian | 81/407 |
| 6,145,418 | A | | 11/2000 | Bares | |
| 6,185,771 | B1 | * | 2/2001 | Trusty, Sr. | 7/128 |
| 6,386,076 | B1 | * | 5/2002 | Swanstrom, Jr. | 81/423 |
| 6,427,565 | B1 | * | 8/2002 | Ping | 81/362 |
| 6,862,961 | B2 | * | 3/2005 | Winkler | 81/367 |
| 2003/0012677 | A1 | * | 1/2003 | Senini | 419/6 |
| 2004/0088827 | A1 | * | 5/2004 | Tillim | 16/430 |
| 2004/0193153 | A1 | | 9/2004 | Sartor | |
| 2005/0211960 | A1 | | 9/2005 | Wagner | |
| 2005/0274237 | A1 | | 12/2005 | Winkler | |
| 2006/0022178 | A1 | | 2/2006 | Wagner | |

FOREIGN PATENT DOCUMENTS

| | | | |
|---|---|---|---|
| DE | 24 07 472 | A1 | 8/1975 |
| DE | 202 16 205 | U1 | 8/2003 |
| EP | 0 303 786 | A | 2/1989 |
| WO | WO-2005/097426 | A | 10/2005 |

* cited by examiner

PLIERS

CROSS-REFERENCE TO RELATED APPLICATIONS

This application is a 371 U.S. National Stage of International Application No. PCT/EP2006/012376, filed Dec. 21, 2006. This application claims priority to German Patent Application No. DE 10 2005 063 221.1, filed Dec. 22, 2005, and DE 10 2006 046 099.5, filed Sep. 28, 2006, which applications are herein expressly incorporated by reference.

The invention relates to a pliers in accordance with the preamble to claim 1, an articulation for a pliers in accordance with the preamble to claim 10, and finally to a method for producing a pliers in accordance with the preamble to claim 16.

Pliers of the type addressed herein are known, as are the associated articulations and production methods. They have a first pliers part and a second pliers part, an articulation connecting them, and handle elements. In conventional pliers, the pliers parts are pivoted outward and inward with respect to an imaginary center axis, the pliers parts performing an opening movement outward and a gripping movement inward. The pliers parts can clamp articles. The handle elements are moved inward and outward relative to an imaginary center axis according to the movement of the pliers parts, an opening movement occurring outward and a gripping movement occurring inward. The pivot movement of the pliers parts and handle elements toward one another is defined by an articulation. Thus when opening and closing the handle elements a larger or smaller V-shaped free area forms between them. It has been found that in many cases the two handle elements spread away from one another when open cannot be grasped with all fingers so that it is not possible to clamp an article held between the pliers parts with optimum force The object of the invention is therefore to create a pliers that does not have this disadvantage and that has handle elements with an optimum ergonomic design.

For attaining this object, a pliers is suggested that has the features cited in claim 1. As usual, the pliers has a first pliers part and a second pliers part, and an articulation that connects these parts to one another. Attached to the pliers parts are handle elements that are moved relative to one another in order to displace the pliers parts from an open first position to a closed second position. The pliers suggested herein is characterized in that the first pliers part is connected rotation-fast to the first handle element while the second pliers part is pivotably linked to the second handle element, that is, the coupling there is not rigid. In addition, a coupling element is provided that creates an additional connection between the second handle element and the first pliers part and/or the first handle element. The coupling element is on the one hand pivotably connected to the second handle element and on the other hand is pivotably connected to the first pliers part or to the first handle element. The hinge point between the coupling element and the second handle element is arranged spaced apart from the hinge point for the second pliers part on the second handle element. In addition, the coupling part is attached at a hinge point on the first pliers part or on the first handle element that is arranged spaced apart from the articulation that connects the two pliers parts. A first imaginary connecting line runs between the articulation and the hinge point of the second pliers part on the second handle element. A second imaginary line runs between the hinge point of the coupling element on the first handle element or on the first pliers part and the hinge point between the coupling element and the second handle element. The connector of the two handle elements to one another and the pliers parts is selected such that the imaginary first and second connecting lines are largely parallel to one another in all functional positions, that is, when the pliers is open and when it is closed. At the same time, a third connecting line runs through the articulation of the two pliers parts and the hinge point between the first pliers part or the first handle element and the coupling element, and a fourth imaginary line runs between the hinge point of the second pliers part on the second handle element and the hinge point of the coupling element on the second handle element. These third and fourth imaginary connecting lines also run largely parallel to one another when the pliers is closed and when it is open.

Thus, a parallelogram connection between the first handle element and the second handle element is created so that the second handle element is displaced largely parallel to the first handle element when the pliers is opened or closed. In this manner it is possible to grasp the second handle element with all four fingers both when the pliers is open and when it is closed so that force can be introduced into the two pliers parts in a much better manner than with conventional pliers.

Additional embodiments of the pliers result from the subordinate claims.

The object of the invention is also to provide an articulation that enables simple and in particular low-friction connection of the two pliers parts so that the forces necessary when grasping articles are reduced to a minimum.

For attaining this object, an articulation is suggested that has the features cited in claim 10. It is distinguished in that it connects the two pliers parts by means of an articulation pin and has an injected plastic ring that reduces to a minimum the friction between the two pliers parts associated with the articulation.

Additional embodiments of the invention result from the subordinate claims.

It is also the object of the invention to provide a method for producing a pliers of the type addressed herein that is distinguished by an ergonomic design.

For attaining this object, a method is suggested that includes the features cited in claim 16. It is distinguished in that the following steps are performed, even in a different sequence: At least one handle element is attached to, preferably injected onto, a pliers part of a pliers. The pliers parts are joined and an articulation is created for connecting the two pliers parts. For attaining the force-optimized connection of the handle elements of the pliers that is desired here, a coupling element is used that is on the one hand pivotably attached in the first pliers part or first handle element and on the other hand is attached to the second handle element. Pivotably attachment is provided here, as well.

Additional embodiments result from the subordinate claims.

The invention is explained in greater detail in the following using the drawings.

Figure 1:
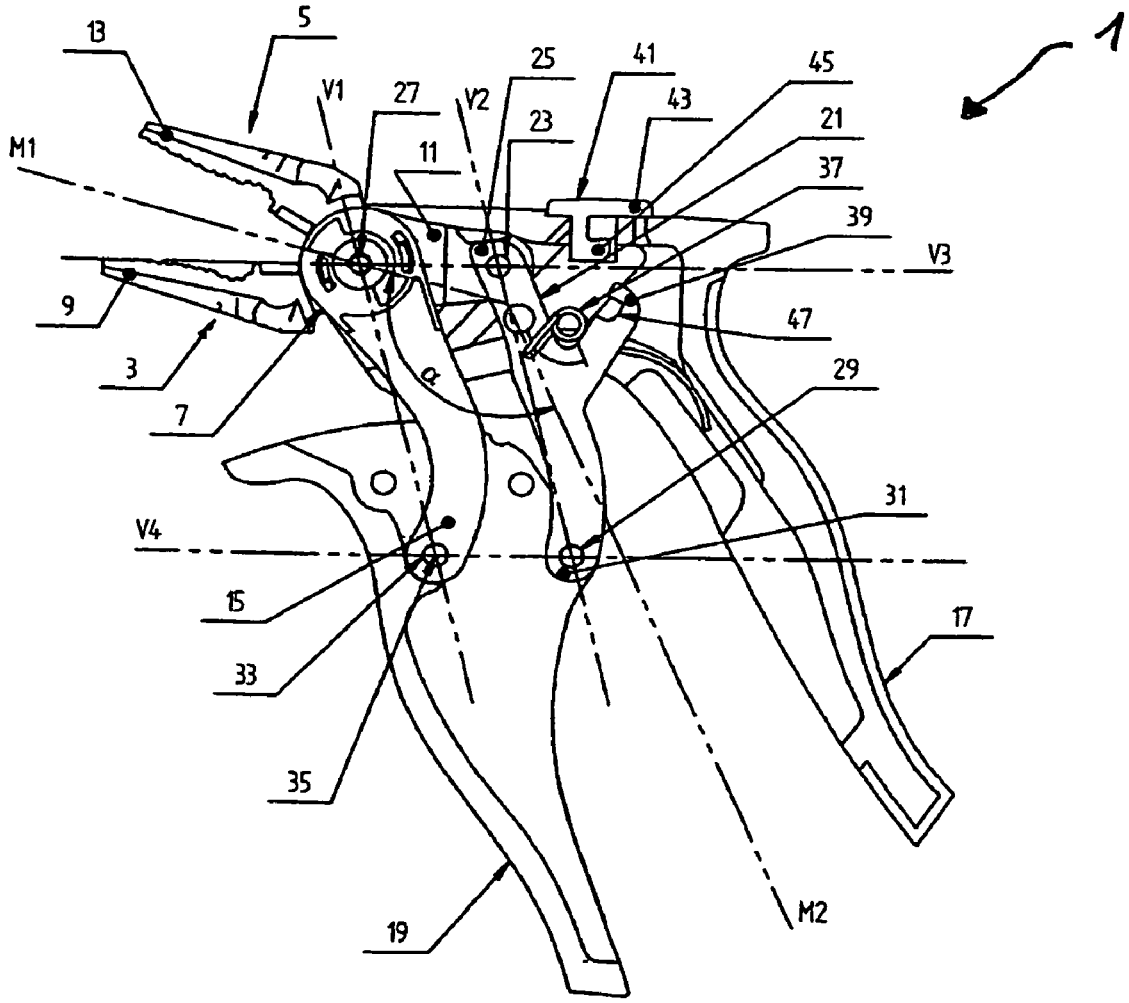
FIG. 1 depicts the principle of a pliers in a first functional position.

The pliers 1 depicted in FIG. 1 has a first pliers part 3 and a second pliers part 5. The pliers parts 3 and 5 are connected to one another via an articulation 7.

The first pliers part 3 has a first gripping jaw 9 and a holding arm 11. The second pliers part 5 has a second gripping jaw 13 and a catch 15.

As can be seen from FIG. 1, the holding arm 11 opposes the first gripping jaw 9 and the catch 15 opposes the second gripping jaw 13 and the articulation 7 is arranged between the ends of the pliers parts 3 and 5.

The pliers 1 also has a first handle element 17 and a second handle element 19, the first handle element 17 being rigidly joined to the holding arm 11 and thus to the first pliers part 3. In contrast, the second handle element 19 is pivotably connected to the second pliers part 5, in this case to the end of the catch 15 that faces away from the articulation 7.

FIG. 1 depicts the pliers 1 in a first functional position, specifically in the open state. The two pliers parts 3 and 5 are thus spread largely in a V-shape, and the handle elements 17 and 19 are disposed spaced apart from one another.

The handle elements 17 and 19 depicted in FIG. 1 are cut away. It can therefore be seen that the pliers 1 includes a coupling element 21 that on the one hand is pivotably attached to the first pliers part 3 or to the first handle element 17 and on the other hand to the second handle element 19. It is provided that the hinge point 23 is arranged in the connection area of the upper end 25 of the coupling element 21 with the first pliers part 3 or the first handle element 17 spaced apart from the rotational axis 27 of the articulation 7. It is correspondingly provided that the hinge point 29 is arranged between the lower end 31 of the coupling element 21 and the second handle element 19 spaced apart from the hinge point 33 between the end 35 of the catch 15 that faces away from the articulation 7 and the second handle element 19.

Drawn in FIG. 1 is a first imaginary connecting line V1 that intersects the rotational axis 27 of the articulation 7 and the hinge point 33, and a second imaginary line V2 that intersects the hinge point 23 between the coupling element 21 and the first pliers part 3 or between the first handle element 17 and the hinge point 29 at the lower end 31 of the coupling element 21. In addition, FIG. 1 indicates a third connecting line V3 that intersects the rotational axis 27 of the articulation 7 and the hinge point 23, and finally a connecting line V4 that intersects the hinge point 33 on the end 35 of the catch 15 and the hinge point 29 on lower end 31 of the coupling element 21. It is clear that the connecting lines V1 and V2 run largely parallel to one another, as do connecting lines V3 and V4. Overall these connecting lines describe a parallelogram. Thus it is clear that a so-called parallelogram articulation is created that connects the two handle elements 17 and 19 to one another.

FIG. 1 furthermore depicts that an imaginary center axis M1 for the two pliers parts 3 and 5 and an imaginary center axis M2 for the handle elements 17, 19 create an angle $\alpha$ of approx. 135°. The pliers parts 3 and 5 are thus angled relative to the handle area of the pliers 1 formed by the handle elements 17 and 19, which significantly enhances their handling. The depiction in accordance with FIG. 1 clearly indicates that the offset pliers parts 3 and 5 are arranged very differently from conventional flat pliers. This is an essential aspect that makes possible non-tiring work with the pliers depicted herein.

The pliers furthermore has a spring element 37 that develops a prestress force, due to which the pliers 1 is displaced into a first functional position, specifically the open position depicted here in FIG. 1. In the exemplary embodiment depicted here the spring element 37 engages on the one hand at the first handle element 17 and on the other hand at the coupling element 21 so that a force is built up, toward the left in FIG. 1, that pushes the second handle element 19 to the left away from the first handle element 17, this opening the pliers parts 3 and 5. Due to the force of the spring element 37, the coupling element 21 is pivoted clockwise about the hinge point 23 until the open position is attained. The force also causes the catch 15 of the first pliers part 3 to be pivoted clockwise about the rotational axis 27 of the articulation 7 so that the first gripping jaw 9 pivots clockwise upward and thus away from the second gripping jaw 13.

Because the two handle elements 17 and 19 are connected like a parallelogram articulation, the second handle element 19 is displaced to the left semi-parallel relative to the first handle element 17. Thus, in contrast to what happens with conventional pliers, no widening V-shaped intermediate space is formed between the handle elements 17 and 19. On the contrary, a user can take the first handle element 17 in his hand, the outside of the handle element 17 being positioned in the interior of his hand and his four fingers grasping the second handle element 19. When closing the pliers, it is already possible for the four fingers to apply force to the second handle element 19 in the open functional position and thus to build up a high gripping and clamping force. Introduction of forces from the hand are improved here by approx. 25%.

The two handle elements 17 and 19 are positioned in the hand of the user practically like the handle of a pistol, while the pliers parts 3 and 5 extend forward toward a working area or an article to be gripped.

It can be seen with nothing further that a very ergonomic working position is assured because of the angled position of the pliers parts 3 and 5 relative to the handle elements 17 and 19 and that uniform clamping forces can created when closing the pliers 1 due to the parallel displacement of the two handle elements 17 and 19 relative to one another, even when the pliers 1 are open.

The pliers 1 also has a locking element 39 that proceeds from the coupling element 21 and is arranged on the side of the coupling element 21 that faces away from the catch 15. When closing the pliers 1, the coupling element 21 pivots counterclockwise about the hinge point 23 and carries the locking element 39 with it until the latter engages in a latch element 41. The latter has an actuating button 43 that is accessible from above and that can be displaced to the rear, that is, to the right in this case, so that a detent lug 45 of the latch element 41 engages in a latch recess 47 of the locking element 39. The latch element 41 can be spring-loaded and displaced into its locking position, that is, to the right relative to the position depicted in FIG. 1.

Figure 2:
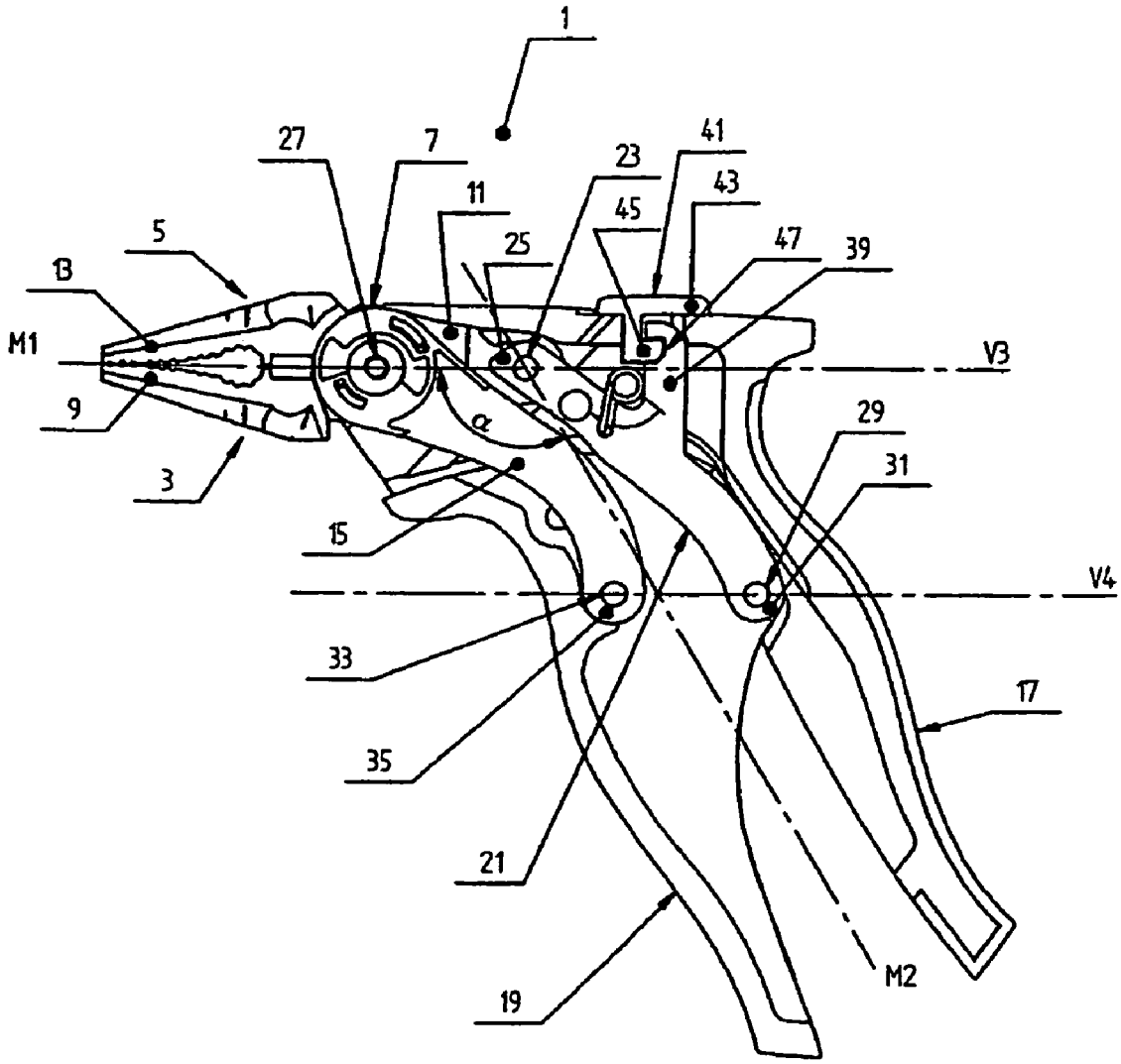
FIG. 2 depicts the principle of the pliers in accordance with FIG. 1 in a second functional position.

FIG. 2 depicts the pliers 1 in a second functional position, specifically closed, the pliers parts 3 and 5, more precisely their first gripping jaw 9 and second gripping jaw 13, being positioned against one another. Identical parts are provided with identical reference numbers; refer to the description for FIG. 1 in order to avoid repetition.

When closing the pliers 1 forces are exerted from the left onto the second gripping element 19 so that it is displaced towards the first gripping element 17. The coupling element 21 rotates counterclockwise about the hinge point 23.

During a pivot movement by the coupling element 21, the catch 15 of the second pliers part pivots counterclockwise, causing the second gripping jaw 13 to be displaced toward the first gripping jaw 9.

As stated, when closing the pliers the second gripping element 19 is displaced largely parallel to the first gripping element 17, but it is also moved upward a bit because the distance between the imaginary third connecting line V3 and the imaginary connecting line V4 becomes smaller. It can be seen that the center axis M1 practically coincides with the connecting line V3 between the gripping jaws 13 and 15.

In the observations made here, it was assumed that when closing the pliers 1 the first gripping element 17 remains practically unpivoted, in particular in order to be able to define the movement of the parts associated with the pliers 1. However, it is clear that a relative movement towards one another by the two gripping elements 17 and 19 leads to closing the pliers 1, regardless of which of the two gripping elements 17, 19 is held fast or displaced, or whether both gripping elements are moved towards one another.

Figure 3:
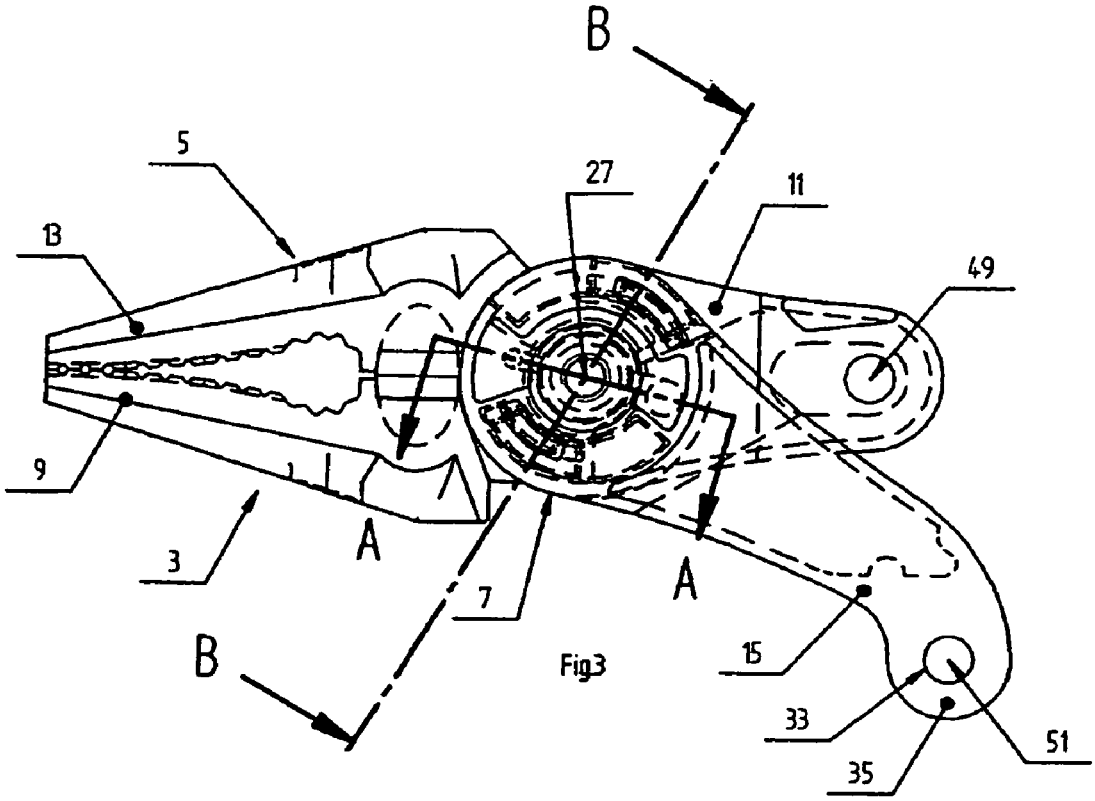
FIG. 3 is an extremely enlarged depiction of the pliers parts for the pliers depicted in FIGS. 1 and 2.

FIG. 3 depicts the two pliers parts 3 and 5 of the pliers 1, greatly enlarged. The additional parts of the pliers 1 are omitted to make it easier to understand. Identical parts are provided with identical reference numbers; refer to the description of previous figures in order to avoid repetition.

It can clearly be seen again that the two pliers parts 3 and 5 are joined to one another by the articulation 7, the axis of rotation 27 of the articulation being perpendicular to the plane of the image in FIG. 3. The holding arm 11 associated with the first pliers part 3 has at its end an opening, preferably a through-opening 49, through which a suitable connecting element can be conducted for linking the coupling element 21 to create the hinge point 23.

Correspondingly, the catch 15 associated with the second pliers part 5 is provided at its end 35 with an opening, preferably a through-opening 51, through which a connecting element can likewise be conducted in order to pivotably link the second gripping element 19 to the catch 15 here and in order to thus create the hinge point 33.

FIG. 3 depicts the pliers parts 3 and 5 in the closed position, as it can also be seen in FIG. 2.

Figure 4:
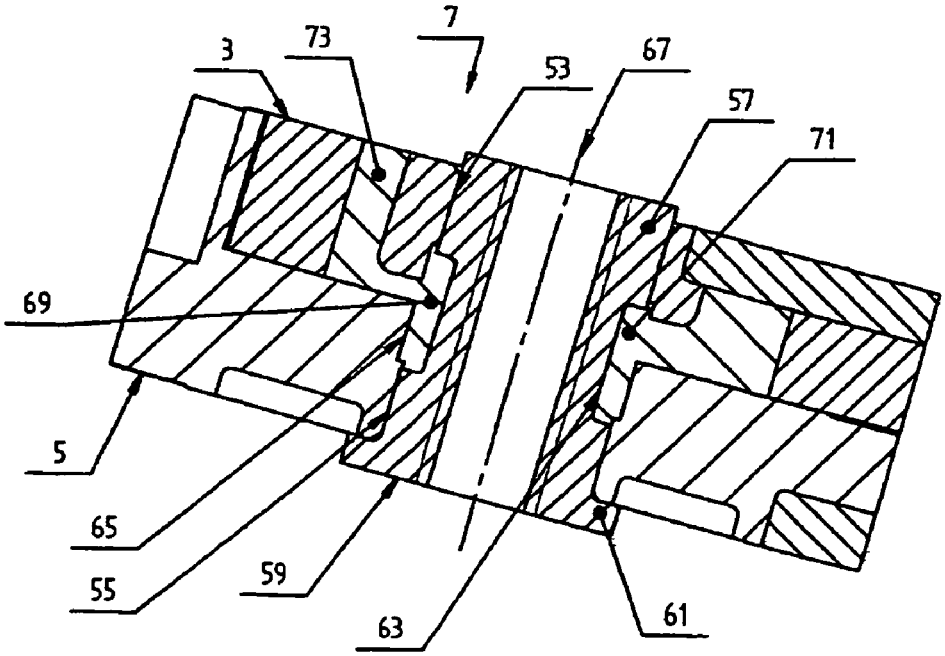
FIG. 4 is a section through the articulation of the two pliers parts along the line A-A shown in FIG. 3; and, FIG. 5 is a section through the articulation of the two pliers parts along the line B-B shown in FIG. 3.

FIG. 4 is a cross-section of the area of the articulation 7, the cross-section running along the line A-A shown in FIG. 3. The first pliers part 3 and the second pliers part 5 can be seen here. Here the first pliers part 3 is provided with a through-opening 53 and the second pliers part 5 is provided with a through-opening 55. The two openings 53, 55 are aligned with one another and receive the base body 57 of an articulation pin 59 that is provided with a collar 61. This prevents the articulation pin 59 from being able to slide through the first and/or second through-opening 55 or 53.

The base body 57 has on its outside an annular groove 63, while provided on the inside of the through-openings 53 and 55 is at least one depression, preferably also an annular groove 65, whereby an area of the annular groove can be associated with the first through-opening 53 in the first pliers part 3 and a second area can be associated with the second through-opening 55 of the second pliers part 5. What is deciding is that the annular groove 63 is on the outside of the articulation pin 59 and the annular groove 65 in the area of the first and second through-openings 53, 55 are disposed, at least in an area, at the same height, measured in the direction of the center axis 67 of the articulation pin 59. In this manner created in the area of the articulation 7 is an interiorly disposed annular space 69 in which a ring 71, preferably made of plastic, is provided. The ring 71 is preferably injected. In addition, provided in the area of the articulation 7 is at least one access channel 73 that is open to the outside and that is connected to the annular space 69, and through which the plastic can be injected into the annular space 69. It is also conceivable to provide a plurality of access channels in order to press plastic into the annular space 69 via a plurality of areas.

The ring 71 reduces the friction of the parts moved against one another in the area of the articulation 7. It can be seen from FIG. 4 that the annular space 69 also extends radially outward even relative to the center axis 67, that is, has a diameter that is larger than that of the through-openings 53 and 55. Because of this the first pliers part 3 only touches the second pliers part 5 outside of the plastic ring 71 created here.

The articulation 7 described here can be produced in a very simple manner: The two pliers parts 3 and 5 are placed upon one another such that the through-openings 53 and 55 in the pliers parts 3 and 5 align. Then the articulation pin 59 can be inserted into the through-openings 53 and 55 until its collar 61 is positioned on the outside of one of the pliers parts. In this case the articulation pin 59 is inserted for instance from below into the through-openings 53, 55 so that the collar 61 is positioned on the outside of the second pliers part 5.

Then a plastic mass can be injected via the at least one access channel 73 in order to create a ring 71 that has a cylindrical segment that extends across a certain height—measured in the direction of the center axis 67. The height here is about one-third of the joint thickness of the two pliers parts 3 and 5. The ring 71 also has a segment that extends radially outward and is somewhat plate-shaped and that is arranged in the contact area between the first pliers part 3 and the second pliers part 5, and specifically in a plane to which the center axis 67 is perpendicular. In this manner the contact surface of the two pliers parts 3 and 5 is reduced in the area of the articulation 7.

Thus, overall the ring 71 reduces the friction between the two pliers parts 3 and 5 and the friction of these two pliers parts with respect to the articulation pin 59.

Given all this, the articulation 7 can be produced cost-effectively in a simple manner. The articulation pin 59 connects the parts associated with the articulation 7, the pliers parts 3 and 5, to one another. The injected ring 71 secures the articulation pin from falling out of the through-openings 53 and 55. The articulation is distinguished in that the friction of the parts connected to one another in the area of the articulation is reduced to a minimum.

From the explanations regarding FIG. 4 it becomes clear that the design of the ring 71 can be broadly adapted to the forces acting on the articulation 7. Thus, it is possible to provide a cylindrical segment that measures higher toward the center axis 67 than is depicted herein. It is also conceivable to change the extension of the ring 71 measured perpendicular to the center axis 67 in order to provide in the contact area between the first and second pliers parts 3, 5 a larger or smaller plastic surface area that contributes to reducing the friction forces in the area of the articulation 7. The friction can also be influenced, in particular reduced, by the selection of special plastic materials.

The two pliers parts 5 and 3 are preferably produced from metal. The so-called MIM process, metal injection molding, also known as metal powder injection molding, is particularly preferred for production.

Handle elements 17 and 19 are attached to the pliers parts 3 and 5 during production of the pliers 1. Preferably attached to one of the pliers parts, in this case to the first pliers part 3, is a fixed handle element 17, that is, it cannot perform a pivot motion relative to the pliers part 3.

Particularly preferred for the production of the pliers 1 is a method in which the first handle element 17 is molded onto, preferably injected onto, the first pliers part 3.

In a further step, the first pliers part 3 can now be connected to the second pliers part 5 in that after the pliers parts 3 and 5 are put together the articulation pin 59 is passed through the through-openings 53 and 55. The ring 71 is then injected to finish the articulation 7.

It can be seen here that the two pliers parts 3 and 5 can also be put together in advance and the articulation pin 59 can be inserted, and then the first handle element 17 can be attached to, preferably injected onto, the first pliers part 3. Particularly preferred is a production method in which the first handle element 17 is molded onto, preferably injected onto, the first pliers part 3, and the ring 71 is injected into the area of the articulation 7.

Different plastic materials adapted to the different loads on the handle element 17 and the ring 71 can be used and the handle element 17 and ring 71 can be injected using the so-called two-component injection process. It is clear that naturally identical plastic materials can also be used for the handle element 17 and the ring 71.

In another step, the parallelogram articulation is then completed in that the coupling element 21 is added; it is preferably pivotably attached to the first pliers part 3 in the area of the through-opening 49. The other end 31 of the coupling element 21 is then pivotably connected to the second handle element 19. The second handle element 19 is connected to the end 35 of the catch 15.

Moreover, the spring element 37 and the latch element 41 are inserted before the first handle element 17 is then completed, in particular by adding a cover or a second half-shell. The second handle element 19 is similarly completed with an associated part.

Preferably used for the handle elements 17 and 19 is a material that provides a particularly good grip in order to prevent slipping when handling the pliers 1. The material must be hard enough to absorb forces that occur when the pliers 1 is used and to be able to conduct those forces to the pliers parts 3 and 5.

It is also conceivable to provide the handle elements 17 and 19 with areas of different plastics in order to enhance the comfort of the user, that is for instance to use softer materials in the area grasped by hand and fingers. In this case, as well, it is very possible to use different plastic materials when producing the handle elements 17 and 19 and to employ the two-component injection molding process.

Using plastic material for the handle elements 17 and 19 is particularly advantageous because even when using metal for producing the pliers parts 3 and 5 the user is insulated therefrom and the risk of suffering an electrical shock when handling the pliers 1 is reduced to a minimum.

Figure 5:
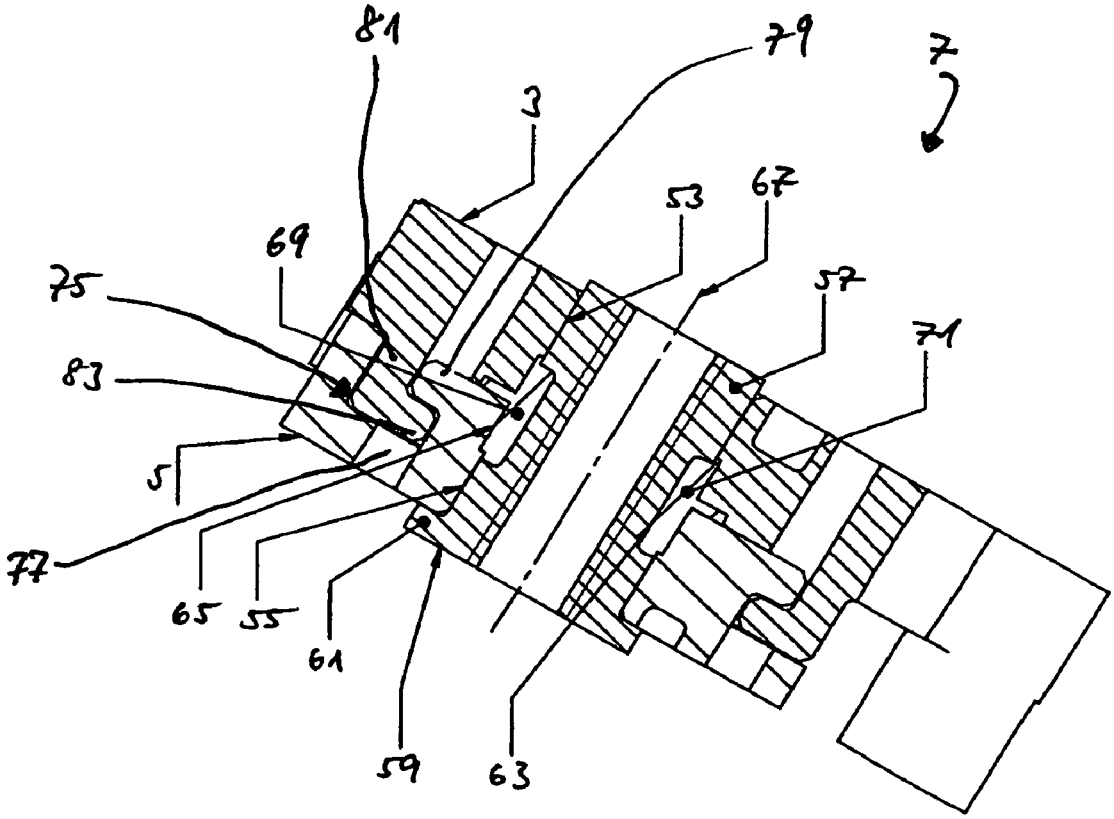

FIG. 5 is a sectional depiction of the articulation 7 between the two pliers parts 3 and 5, the section running along the line B-B shown in FIG. 3 and being disposed on an imaginary plane that also includes the center axis 67 of the articulation pin 59. Identical parts are provided with identical reference numbers; refer especially to the description for FIG. 4.

The two pliers parts 3 and 5 of the pliers 1 are also depicted greatly enlarged in FIG. 5 in the section along the line B-B shown in FIG. 4. The through-opening 53 in the first pliers part 3 and the through-opening 55 in the second pliers part 5 are aligned with one another and receive the articulation pin 59, which in this case is arranged such that its collar 61, which projects radially over its circumferential surface, is positioned on the second pliers part 5, that is, it cannot pass through the two through-openings 53 and 55. As was already explained using FIG. 4, the outside of the base body 57 of the articulation pin 59 is provided with an annular groove 63, while the inside of the through-openings 53 and 55 have a depression so that there is an annular groove 65 into which a plastic mass is injected. A ring 71 is created in this manner and on the one hand it engages in the annular groove 63 in the base body 57 of the articulation pin 59 and on the other hand it engages in the depressions that are present in the through-openings 53 and 55, that are thus present in the pliers parts 3 and 5. The ring 71 thus engages in the two pliers parts 3 and 5 and in the articulation point 59 so that it is not possible to push the latter toward its center axis 67 out of the through-openings 53 and 55. Thus the ring 71 secures the two pliers parts 3 and 5.

In addition, it is provided that the pliers parts 3 and 5 are coupled to one another by a bayonet-like connector 75. The latter is created in that a groove 77 that runs in a circular arc is inserted into one of the two pliers parts, in this case in the second pliers part 5. It can extend across the thickness of the second pliers part 5. At least in one area of its arc-shaped extension the groove 77 is provided with a projection 79 that projects into the groove radially and outward with respect to the center axis 67 of the articulation pin 59.

For creating the bayonet-like connector 75, the other pliers part, in this case the first pliers part 3, has a projection 81 that runs parallel to the center axis 67 and that on its side that faces away from the base body of the pliers part 3 includes a segment that projects radially inward toward the center axis 67 and that acts as a counterbearing 83.

The length of the projection 81 and the thickness of the counterbearing 83 are selected such that the counterbearing 83 that projects radially inward engages under the projection 79 when the connector 75 is in a functional position so that the two pliers parts 3 and 5 are locked with one another.

In order to create a connector 75 of the type described herein, at least one groove 77 is provided and at least one projection 81 that projects into the groove 77 is provided. It is preferably provided that two point symmetrical grooves 77 that are curved in a circular arc are provided in one of the pliers parts, in this case in the second pliers part 5. Correspondingly, two projections 81 that are also shaped like circular arcs should be provided on the other part, in this case then on the first pliers part 3.

In one area, measured perpendicular to the center axis 67, the side of the groove 77 that faces the first pliers part 3 is embodied wide enough that the counterbearing 83 of the first pliers part 3 can be inserted there. This area of the groove 77 that acts as a receiving segment is arranged such that the projection 81 with the counterbearing 83 can engage in the receiving segment of the groove 77 when the two pliers parts 3 and 5 are placed in their most open functional position. When the two pliers parts 3 and 5 are then pivoted somewhat into their closed position, the counterbearing 83 engages below the projection 79 of the groove 77 that projects radially outward so that the projection 81 of the first pliers part 3 is securely held in the groove 77 of the second pliers part 5.

It is preferably provided that, when the two pliers parts 3 and 5 are in their completely closed position, that is, when the pliers 1 is closed, the counterbearing 83 is positioned completely under the projection 79 and the two pliers parts 3 and 5 are optimally held against one another by the connector 75. If the pliers parts 3 and 5 of the pliers are opened somewhat, they are held together in the area of the connector 75 by the projection 79 that is positioned largely over the counterbearing 83. Thus excellent stability for the connecting area of the pliers parts 3 and 5 results in the articulation 7 when the pliers 1 are employed.

When the pliers 1 is most open the two pliers parts 3 and 5 are held apart from one another exclusively by the ring 71 produced from plastic. The user does suffer any disadvantages because the pliers is not used in this position. The circular arc-shaped counter bearing 83 engages below the projection 79 as soon as the pliers 1 is somewhat closed and used possibly for work. However, particularly when the pliers is open only across a certain area and likewise high forces must be applied, the counterbearing 83 engages far below the projection 79 so that the articulation 7 is very stable because of the bayonet-like connector 75 and can absorb high forces.

The following results from the explanations for the figures:

The pliers 1 is distinguished in that its work area, that is the pliers parts 3 and 5, is angled relative to the handle area, the first and second handle elements 17, 19. Thus the pliers 1 can be grasped similar to a pistol grip so that a natural grip is retained when grasping and holding articles. Because the two handle elements 17 and 19 perform a parallel displacement relative to one another when the pliers 1 transitions from open to closed, forces can be exerted with all four fingers even when the pliers 1 is open. Thus it is possible to build up high clamping forces with the pliers 1 and also to hold large articles securely.

The special relative motion of the two handle elements 17 and 19 is created using the parallelogram articulation, which connects the two pliers parts 3, 5 and the two handle elements 17 and 19.

Using a spring element 37 it is possible for the pliers 1 to assume its first functional position, the open position, in a semi-automatic manner. It is also possible to lock the two handle elements 17 and 19 to one another in their most proximate function. A latch element 41 is provided that can also be spring loaded and that automatically assumes a closed position. Thus, if the pliers 1 is closed it locks automatically. The latch element 41 can also be fixed in the open position in order to be able to work undisturbed. It has been found that the pliers parts 3 and 5 that are subjected to particular loads, especially their gripping jaws 9 and 13, can be produced from metal. The MIM method has been particularly successful. Since the gripping elements 17 and 19 are preferably produced from plastic, the user of the pliers 1 can touch current-conducting parts with nothing further without the danger of an electric shock. Conversely, static charges from the user are prevented from jeopardizing sensitive articles due to discharge.

The articulation 7 of the pliers 1 is distinguished in that it is particularly low friction because a plastic ring 71 is provided in its interior. It extends across the contact area between the two pliers parts 3 and 5 and the articulation pin 59 of the articulation 7, but also across an area of the contact surface between the pliers parts 3 and 5. The friction forces can be reduced to a minimum, in particular with the selection of suitable plastics that can also preferably be processed in an injection molding method. This contributes to minimizing the forces necessary when handling the pliers 1.

During production of the pliers 1, plastic injection molding is used as much as possible, it being possible to produce at least the first handle element 17 and the ring 71 in a common method step, even if different plastic materials are used for the two plastic parts and are adapted to the different loads in the handle area and in the area of the articulation 7. In this case two-component injection molding methods can be employed.

Two-component injection molding methods can be used not only for the more or less simultaneous production of handle elements and the ring 71, but also for the production of the handle elements themselves, which can include plastics with different properties. First of all, hard plastics are used that absorb the forces that occur when using the pliers 1 and that can also have a reinforcing core made of metal. Secondly, plastics are used that prevent the user's hand from slipping from the handle elements 17 and 19, and that furthermore have inherent elasticity in order to reduce the loads on the skin of the user when he uses the pliers 1.

The invention claimed is:

1. A pliers comprising:

first and second pliers parts pivotably interconnected at an articulation, first and second handle elements associated with the first and second pliers parts, the first pliers part connected rotation-fast to the first handle element, the second pliers part pivotably connected to the second handle element; and a coupling element pivotably attached to the second handle element, a first hinge point of the coupling element carried by the second handle element spaced apart from a second hinge point of the second pliers part on the second handle element, the coupling element pivotably attached to the first pliers part or to the first handle element, a third hinge point of the coupling element arranged on the first pliers part or on the first handle element spaced apart from the articulation that connects the first and second pliers parts;

wherein the articulation includes an articulation pin and a plastic ring.

2. The pliers according to claim 1, wherein at least one of the pliers parts is constructed of metal.

3. The pliers according to claim 1, wherein the pliers parts are produced with a metal injection molding (MIM) process.

4. The pliers according to claim 1, wherein the handle elements are constructed of plastic.

5. The pliers according to claim 1, wherein the first and second handle elements are produced with a plastic injection molding method and are injection molded onto the first and second pliers parts, respectively.

6. The pliers according to claim 1, wherein the plastic ring is injection molded and can be added to the articulation.

7. The pliers according to claim 1, further comprising a spring element for displacing the pliers into an open position.

8. The pliers according to claim 1, further comprising a locking element.

9. The pliers according to claim 1, wherein each of the pliers parts includes a through-opening receiving the articulation pin.

10. The pliers according to claim 9, wherein an interior of at least one of the through-openings has at least one depression.

11. The pliers according to claim 10, wherein the at least one depression is an annular groove.

12. The pliers according to claim 1, wherein an exterior of the articulation pin has an annular groove.

13. The pliers according to claim 1, wherein a center axis of the through-openings and that of the articulation pin coincide, and in that the at least one depression or the annular groove on an inside of the through-openings and the annular groove on the outside of the articulation pin—seen in the direction of the center axis—are formed, at least in an area, at the same height, so that an annular space is formed for the ring.

14. The pliers according to claim 13, further comprising an access channel that opens at least outward and leads to the annular space.

15. The pliers according to claim 1, further comprising a first imaginary connecting line running between the articulation and the second hinge point, the first imaginary connecting line being generally parallel to a second imaginary connecting line connecting the third hinge point and the first hinge point.

16. A pliers comprising:

first and second pliers parts pivotably interconnected at an articulation, first and second handle elements associated with the first and second pliers parts, the first pliers part connected rotation-fast to the first handle element, the second pliers part pivotably connected to the second handle element; and a coupling element pivotably attached to the second handle element, a first hinge point of the coupling element carried by the second handle element spaced apart from a second hinge point of the second pliers part on the second handle element, the coupling element pivotably attached to the first pliers part or to the first handle element, a third hinge point of the coupling element arranged on the first pliers part or on the first handle element spaced apart from the articulation that connects the first and second pliers parts;

wherein the articulation includes an articulation pin and an injected ring.

* * * * *